US006575602B2

(12) United States Patent
Sools et al.

(10) Patent No.: US 6,575,602 B2
(45) Date of Patent: Jun. 10, 2003

(54) LUMINAIRE WITH A LIGHT REFLECTING COATING

(75) Inventors: Franciscus Guillaume Peter Sools, Eindhoven (NL); Jean Paul Entrop, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/824,617

(22) Filed: Apr. 2, 2001

(65) Prior Publication Data

US 2001/0040809 A1 Nov. 15, 2001

(30) Foreign Application Priority Data

Apr. 4, 2000 (EP) ..... 00201209
Mar. 23, 2001 (EP) ..... 01201100

(51) Int. Cl.[7] ..... F21V 13/02
(52) U.S. Cl. ..... 362/343; 362/347; 428/328
(58) Field of Search ..... 362/147, 341, 362/343, 347, 520; 359/584, 599; 428/323, 328, 330

(56) References Cited

U.S. PATENT DOCUMENTS 5,905,594 A 5/1999 McGregor et al. ..... 359/599

FOREIGN PATENT DOCUMENTS

WO WO9913013 3/1999 ..... C09D/5/33

*Primary Examiner*—Sandra O'Shea
*Assistant Examiner*—John Anthony Ward
(74) *Attorney, Agent, or Firm*—Ernestine C. Bartlett

(57) ABSTRACT

The luminaire has a molded reflector body (1) comprising a reflective coating (3) with light reflective particles (10) and a binder (11) and having a substrate side (12) and an outer surface (13). The coating (3) has a smooth optical waveguiding surface due to the absence of particles (10) at its outer surface (13) and to the light-transmission properties of the binder (11). Owing to these properties, the coating (3) has a high degree of specular reflection, thereby both increasing the lumen output ratio and improving the light directional properties of the luminaire.

9 Claims, 2 Drawing Sheets

LUMINAIRE WITH A LIGHT REFLECTING COATING

Figure 1:
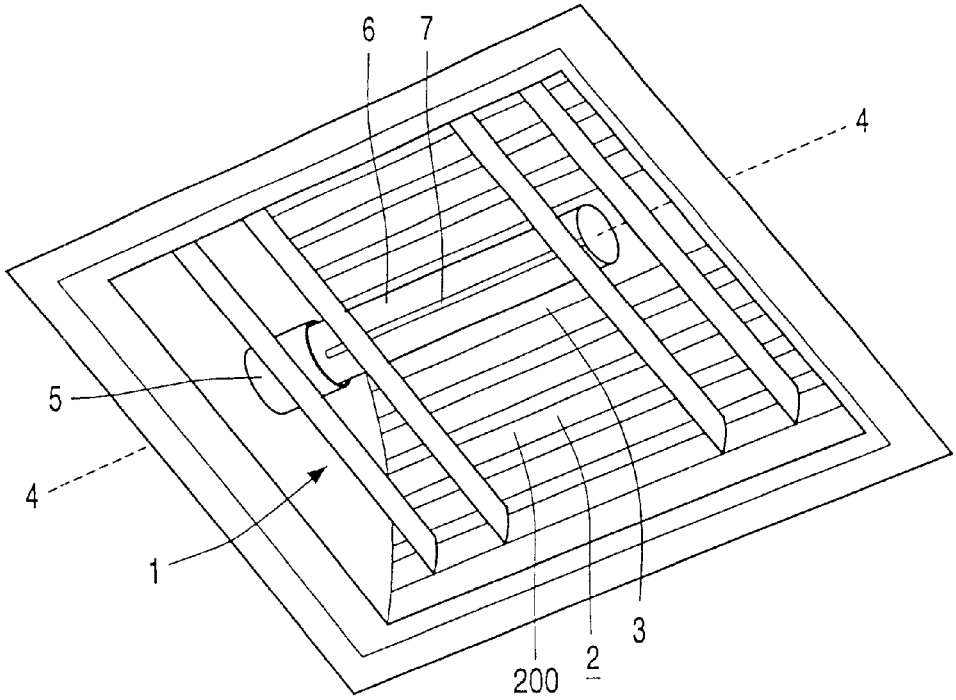

The invention relates to a luminaire comprising:

a reflector body with a reflector portion having a reflective surface and provided with a coating, which coating comprises light-reflecting particles, a substrate side, and an outer side; and contact means for electrically connecting a light source.

Such a luminaire is known from U.S. Pat. No. 5,905,594. The reflector portion in the known luminaire is provided with a coating comprising reflecting white particles, for example polytetrafluoroethylene particles. In the known luminaire the reflective surface is formed by the coating. The coating has a total reflection of approximately 95% of visible light, for example originating from the light source. The manufacture of the known luminaire is a comparatively cumbersome and difficult process. It is a characteristic of the known coating that it shows substantially exclusively diffuse reflection. Diffuse reflection means that light is scattered. As a result, a considerable portion of the light does not issue from the luminaire to the exterior until after multiple reflections against the coating. In spite of the high total reflection of the coating, a light loss does occur upon each reflection because the incidence of light on the coating will always involve not only reflection but also absorption of light. This absorption may be comparatively great because light-absorbing dust particles deposit themselves on the coating when the coating is exposed to the environment. The combination of multiple reflections and the increased absorption of light by the dust particles causes the light losses to increase further. As a result, the known luminaire has the disadvantage of a comparatively low light output ratio, especially after the coating has been exposed to its surroundings for some time. The light output ratio of the luminaire is the ratio of the quantity of light issuing from the luminaire to the quantity of light generated by the light source. Since the diffusely scattered light is comparatively difficult to shape into a beam and to direct, the known luminaire with such a diffusely reflecting coating also has the disadvantage that it is comparatively unsuitable for use in accent lighting.

It is an object of the invention to provide a luminaire of the kind described in the opening paragraph in which the above disadvantages are counteracted.

According to the invention, this object is achieved in that the luminaire of the kind described in the opening paragraph is characterized in that the coating comprises a light-transmitting binder and is substantially free from light-reflecting particles at its outer side. Since there are no light-reflecting particles at the outer side, but the particles are fully accommodated in a layer formed by the binder present in the coating, the outer side of the coating has a comparatively smooth surface. The binder, which transmits visible light, forms a transparent, light-guiding layer over the light-reflecting particles and over the reflector portion. It was surprisingly found that not only diffuse reflection, but also a high degree of specular reflection of visible light occurs at the coating owing to the transparent light-guiding layer. The high degree of specular reflection means that substantially all light originating from the light source issues from the luminaire to the exterior directly or after only one reflection. As a result, there is hardly any light loss owing to reflection against the coating, as in the known luminaire, and the luminaire according to the invention has a comparatively high light output ratio. It was found that light-absorbing dust particles adhere less readily to the coating because the surface of the outer side of the coating is comparatively smooth, so that also the light output ratio of the luminaire decreases comparatively little during its operational life. In addition, the luminaire according to the invention is suitable for use in accent lighting because of its coating with a high degree of specular reflection.

In a first advantageous embodiment the reflective surface of the reflective portion is partly formed by the coating according to the invention. This can be realized in that the reflector portion has at least an area which is free from the coating or wherein the coating is partly covered, for instance with a further coating having optical properties different from those of the said inventive coating. It is thereby enabled that the area can be given other, desired optical properties, for example, the area can be either left blank or alternatively that the further coating provides for different reflective properties. The further coating may be provided over the previous applied inventive coating comprising the transparent light-guiding layer. By selection of the number, the position, the dimensions and the optical properties of the area, it is possible to obtain the reflector portion having its reflective surface being optimized for a selected purpose.

In a further embodiment, the light-reflecting particles in the coating of the luminaire are present in a quantity of $\leqq 75\%$ by volume with respect to the quantity of binder. Owing to the comparatively low percentage by volume of the particles with respect to the binder, the particles have the possibility of settling on or adjacent the substrate side during a drying process of the coating, for example in that they have a higher specific mass than the binder. It is thus achieved in a comparatively simple manner that the particles are fully enclosed in a layer formed by the binder present in the coating. Another favorable possibility for obtaining the transparent light-guiding layer over the light-reflecting particles is formed by a dual-layer or multilayer coating, for example with a light-transmitting layer at the outer side which is substantially free from light-reflecting particles and a further layer containing light-reflecting particles between the light-transmitting layer and the substrate side of the coating.

In a further embodiment of the luminaire, the light-reflecting particles are surrounded by a pigment skin. This was found to cause a further improvement in the specular reflection of the coating. To improve the specular reflection still further, the pigment skin and the light-reflecting particles preferably have different refractive indices. A suitable pigment skin was found to be aluminum oxide.

Experiments have further shown that light-reflecting particles chosen from the group formed by halophosphates, calcium pyrophosphate, strontium pyrophosphate, and titanium dioxide are highly suitably for the coating. These light-reflecting particles can be very well combined with the light-transmitting binder, for example a silicone binder, a fluoro polymer (for example THV 200), or acrylate. A luminaire provided with a coating of such a composition of particles and binder on its reflector portion has very good light-reflecting and beam-shaping properties.

Obviously, the type of electric lamp is immaterial to the invention. The lamp may be an electric discharge lamp or an incandescent lamp. The electric element, an incandescent body in the case of an incandescent lamp, may be accommodated in an inner envelope in the lamp vessel. In the case of a halogen incandescent lamp, the lamp vessel will contain a halogen-containing filling, in the inner envelope, if present. The inner envelope is usually present if the electric element is a pair of electrodes in an ionizable gas.

It is further noted that WO 99/13013 discloses a reflector body with a light-reflecting carrier manufactured from metal, i.e. aluminum, on which a transparent coating is provided. The coating of the reflector body comprises a transparent binder and transparent particles, for example of silicon dioxide. The granular surface structure of the coating has the effect that the known reflector body has not only specular reflection owing to the aluminum carrier material but also a certain degree of diffuse scattering of the light incident on the coating. The known reflector body has the disadvantage of a comparatively low total reflection of approximately 83%.

Figure 2:
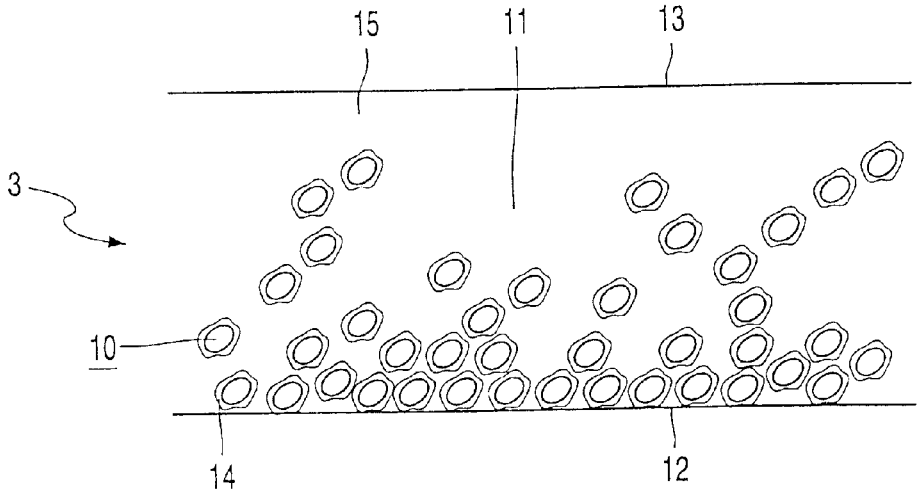
Figure 3:
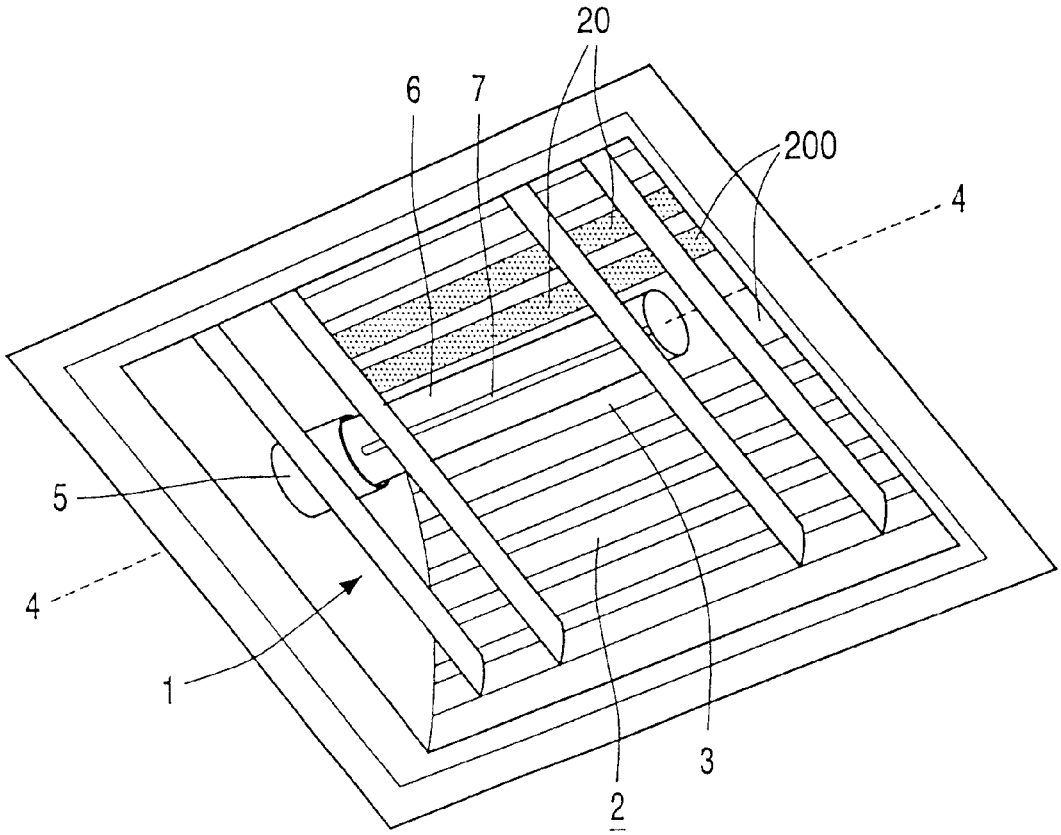

Embodiments of a luminaire according to the invention are diagrammatically shown in the drawing, in which FIG. 1 shows a first embodiment in perspective view;

FIG. 2 shows a detail of the coating of the luminaire of FIG. 1 in cross-section; and FIG. 3 shows a second embodiment in perspective view.

FIG. 1 shows a luminaire with a reflector body 1 having a concave reflector portion 2, an elongate asymmetrical concave reflector in the Figure, with a reflector axis 4, having a reflective surface 200, said reflector portion 2 being provided with a light-guiding/reflecting coating 3. In the described embodiment the reflective surface 200 is formed by the coating 3. Contact means 5 are provided in the concave reflector portion 2 for the electrical connection of an electric lamp 6 with a light source 7. The electric lamp 6 in the Figure is a high-pressure gas discharge lamp, for example a HPI-T 250 W type, which is placed in a luminaire according to the invention, for example a Philips MPF 211 type, provided with the coating 3. The light source 7 is positioned on the reflector axis 4 of the reflector portion 2. The coating 3 has a total reflection of more than 95%. Luminaires according to the invention have a light output ratio of approximately 89%, whereas corresponding conventional luminaires, such as the Philips MPF 211, have a light output ratio of approximately 74%. After a period of time, i.e. at the 800-hour operational life moment, a light output ratio of approximately 88% was measured, i.e. a decrease in the light output ratio of the luminaire according to the invention of no more than approximately 1% over this period. The reflection of luminaires according to the invention is partly diffuse, partly specular. As a result, luminaires according to the invention provide a light distribution with comparatively well defined contours, with a comparatively narrow beam, and with a comparatively high intensity, for example with a top value for the intensity of approximately 800. The top value obtained with corresponding conventional luminaires is approximately 650, standardized to a same scale. The luminaire as shown in the Figure is highly suitable for canopy lighting in closed ceilings such as, for example, in gas filling stations.

FIG. 2 shows a detail of the coating 3 of the luminaire of FIG. 1 in cross-section. The coating has light-reflecting particles 10, a light-transmitting binder 11, a substrate side 12, and an outer side 13. The light-reflecting particles 10 are positioned adjacent the substrate side 12 in the coating 3, and the coating 3 is substantially free from the light-reflecting particles 10 at the outer side 13 because there is a light-transmitting layer 15 at the outer side 13. It is visible in the Figure that the coating 3 is mainly formed by the binder 11 and that the light-reflecting particles 10 account for approximately 25% by volume with respect to the volume of the coating 3. The light-reflecting particles 10 are titanium oxide particles, having a reflection index of 2.32, which are provided with a pigment skin 14 of aluminum oxide, having a reflection index of 1.63; such coated particles are commercially available, for example under the trade name Kemira 675. The binder is a silicone binder, for example RTV 615. The coating 3 is provided on the reflector portion through spraying of a suspension comprising the binder 11, the light-reflecting particles 10, and a solvent, for example cyclohexane. Then the coating is dried in the air for approximately 45 minutes at a temperature of approximately 130° C. The light-reflecting particles 10 deposit themselves at the substrate side 12 of the coating 3 during drying.

FIG. 3 shows a second embodiment of the luminaire of the invention in which the reflective surface 200 is partly formed by the coating 3. In the embodiment the reflective portion 2 has two areas 20, being provided with a further coating, being a specular reflective coating, this further specular reflective coating being aluminum. Because of the specular reflective areas 20 in the luminaire, compared to the luminaire of FIG. 1, the light distribution of the luminaire of FIG. 3 has even better well defined contours, with a narrower beam, and with an increased intensity. Under circumstances, variations in the areas 20 in the luminaire of FIG. 3 might lead to a light output which is fractionally lower light output than the light output of the luminaire of FIG. 1. However, this fractionally lower light output is by far outweighed by obtainable improved properties, i.e. in the luminaire of FIG. 3 the increased intensity of the narrower beam. Said improved properties are of interest for applications of the luminaire of FIG. 3 for canopy lighting in closed ceilings such as, for example, in gas filling stations. The narrower beam having a top value for the intensity of the light distribution up to approximately 950 compared to a corresponding value of 800 for the luminaire of FIG. 1, standardized to a same scale.

What is claimed is:

1. A luminaire comprising:

a reflector body with a reflector portion having a reflective surface and provided with a coating, said coating (3) having a substrate side, and an outer side; and contact means for electrically connecting a light source, characterized in that the coating comprises light-reflecting particles and a light transmitting binder and wherein the coating is substantially free from light-reflecting particles at the outer side.

2. A luminaire as claimed in claim 1, characterized in that the reflective surface of the reflector portion is partly formed by the coating.

3. A luminaire as claimed in claim 1, characterized in that the reflector portion has at least an area which is free from the coating or wherein the coating is covered with a further coating having optical properties different from those of the said coating.

4. A luminaire as claimed in claim 1, characterized in that the coating comprises the light-reflecting particles and the binder in a ratio of $\leqq 75\%$ by volume.

5. A luminaire as claimed in claim 1, characterized in that the coating comprises a light-transmitting layer at the outer side which is substantially free from light-reflecting particles and a further layer comprising light-reflecting particles between the light-transmitting layer and the substrate side.

6. A luminaire as claimed in claim 1, characterized in that the light-reflecting particles are surrounded by a pigment skin.

7. A luminaire as claimed in claim 6, characterized in that the pigment skin and the light-reflecting particles have different refractive indices.

8. A luminaire as claimed in claim 1, characterized in that the light-reflecting particles are chosen from a group formed by halophosphates, calcium pyrophosphate, strontium pyrophosphate, and titanium dioxide.

9. A luminaire as claimed in claim 1, characterized in that the light-transmitting binder comprises a silicone binder.

* * * * *